US008887456B2

(12) United States Patent
Hyams

(10) Patent No.: US 8,887,456 B2
(45) Date of Patent: Nov. 18, 2014

(54) KIT FOR PRODUCING A STAIR CASE

(75) Inventor: Jonathan Hyams, Bristol (GB)

(73) Assignee: Jonathan Hyams, Pensford (GB)

( * ) Notice: Subject to any disclaimer, the term of this patent is extended or adjusted under 35 U.S.C. 154(b) by 137 days.

(21) Appl. No.: 13/510,573

(22) PCT Filed: Nov. 18, 2010

(86) PCT No.: PCT/EP2010/067776

§ 371 (c)(1),
(2), (4) Date: Jul. 31, 2012

(87) PCT Pub. No.: WO2011/061266

PCT Pub. Date: May 26, 2011

(65) Prior Publication Data

US 2012/0304560 A1 Dec. 6, 2012

(30) Foreign Application Priority Data

Nov. 19, 2009 (GB) ..... 0920272.2

(51) Int. Cl.
*E04F 11/00* (2006.01)
*E04F 11/025* (2006.01)
*E04F 21/26* (2006.01)

(52) U.S. Cl.
CPC ..... *E04F 21/26* (2013.01); *E04F 11/025* (2013.01)
USPC ..... 52/187

(58) Field of Classification Search
CPC ..... E04F 11/025; E04F 11/035; E04F 11/09; E04F 11/104; E04F 11/1041; E04F 11/02; E04F 11/0255; E04F 11/028
USPC ..... 52/182, 184, 185, 186, 188, 191
See application file for complete search history.

(56) References Cited

U.S. PATENT DOCUMENTS

| | | | | | |
|---|---|---|---|---|---|
| 767,955 | A | | 8/1904 | Potts | |
| 838,266 | A | * | 12/1906 | McKee et al. | 52/184 |
| 1,568,568 | A | * | 1/1926 | Nagin | 52/191 |
| 1,893,876 | A | * | 1/1933 | Anderson | 52/191 |
| 2,021,457 | A | * | 11/1935 | MacKenzie | 52/191 |
| 2,867,855 | A | * | 1/1959 | Xanten | 182/97 |
| 2,879,556 | A | * | 3/1959 | Lyons | 52/191 |
| 3,196,997 | A | * | 7/1965 | Hager | 52/182 |
| 3,393,481 | A | * | 7/1968 | Meuret | 52/188 |
| 3,863,348 | A | * | 2/1975 | Herbst | 33/494 |
| 3,909,997 | A | * | 10/1975 | Eickhof | 52/188 |

(Continued)

FOREIGN PATENT DOCUMENTS

| | | | |
|---|---|---|---|
| JP | 2269266 | A | 11/1990 |
| JP | 8302989 | A | 11/1996 |

OTHER PUBLICATIONS

Mowat W et al: "A treatise on stairbuilding and handrailing," Jan. 1, 1989, pp. 1-64.

*Primary Examiner* — Mark Wendell
*Assistant Examiner* — Keith Minter
(74) *Attorney, Agent, or Firm* — Maschoff Brennan

(57) ABSTRACT

A kit for assembling to produce a staircase, the kit comprising: a pair of star supports (12); a plurality of treads (16); a plurality of risers (18); a plurality of tread supports (14) for supporting treads when the staircase is assembled; and means defining the correct position of the plurality of tread supports on the stair supports to produce a staircase to a given specification.

9 Claims, 8 Drawing Sheets

(56) References Cited

U.S. PATENT DOCUMENTS

| | | | | | |
|---|---|---|---|---|---|
| 3,994,113 | A * | 11/1976 | Souza, Jr. | 52/741.2 |
| 4,050,203 | A * | 9/1977 | Souza, Jr. | 52/185 |
| 4,124,957 | A * | 11/1978 | Poulain | 52/183 |
| 4,154,032 | A * | 5/1979 | Strub | 52/188 |
| 4,355,700 | A * | 10/1982 | Matthews et al. | 182/83 |
| 4,367,613 | A * | 1/1983 | Strub | 52/188 |
| 4,406,347 | A * | 9/1983 | Stathopoulos | 182/1 |
| 4,580,352 | A | 4/1986 | Wilson | |
| 5,293,722 | A * | 3/1994 | Reimann | 52/182 |
| 5,502,933 | A * | 4/1996 | Skillern | 52/182 |
| 5,636,483 | A | 6/1997 | Wille | |
| 5,806,254 | A * | 9/1998 | Bennett | 52/182 |
| 5,983,580 | A * | 11/1999 | Carr | 52/187 |
| 6,088,977 | A * | 7/2000 | Lawrence | 52/182 |
| 6,318,033 | B1 * | 11/2001 | Birch et al. | 52/182 |
| 6,354,403 | B1 * | 3/2002 | Truckner et al. | 182/228.1 |
| 6,397,529 | B1 * | 6/2002 | Grenier | 52/182 |
| 6,763,912 | B2 * | 7/2004 | Robinson et al. | 182/115 |
| 6,769,221 | B1 * | 8/2004 | Green | 52/832 |
| 6,839,977 | B1 | 1/2005 | Truckner | |
| 6,868,944 | B2 * | 3/2005 | Truckner et al. | 182/228.1 |
| 7,096,592 | B2 * | 8/2006 | Truckner | 33/562 |
| 7,497,060 | B2 * | 3/2009 | Truckner | 52/741.2 |
| 7,552,564 | B2 * | 6/2009 | Kressin | 52/187 |
| 7,627,955 | B1 * | 12/2009 | Perkey | 33/427 |
| 7,866,443 | B2 * | 1/2011 | Truckner et al. | 182/228.1 |
| 7,934,344 | B2 * | 5/2011 | Truckner | 52/183 |
| 7,946,085 | B2 * | 5/2011 | Prins | 52/191 |
| 7,954,249 | B1 * | 6/2011 | Perkey | 33/427 |
| 8,033,063 | B2 * | 10/2011 | Won | 52/188 |
| 8,307,603 | B1 * | 11/2012 | Mitchell et al. | 52/741.2 |
| 2007/0017169 | A1 * | 1/2007 | Gibson | 52/182 |
| 2007/0144084 | A1 * | 6/2007 | Barry et al. | 52/187 |
| 2008/0216421 | A1 * | 9/2008 | Chung et al. | 52/179 |
| 2008/0216422 | A1 * | 9/2008 | Chung et al. | 52/188 |
| 2009/0151275 | A1 * | 6/2009 | Naccarato et al. | 52/182 |
| 2012/0011786 | A1 * | 1/2012 | Turner et al. | 52/182 |
| 2013/0283711 | A1 * | 10/2013 | Cusson et al. | 52/182 |

* cited by examiner

KIT FOR PRODUCING A STAIR CASE

CROSS-REFERENCES TO RELATED APPLICATION

The present application claims priority to PCT/EP2010/067776, filed Nov. 18, 2010 which claims priority to Great Britain Patent Application No. 0920272.2, filed Nov. 19, 2009 entitled "KIT FOR PRODUCING A STAIR CASE" incorporated by reference for all purposes.

TECHNICAL FIELD

The present invention relates to a kit for producing a staircase.

BACKGROUND TO THE INVENTION

Traditionally when a staircase is required for a building such as a domestic dwelling a joiner visits the building and takes measurements of the vertical distance between the downstairs and upstairs floors to be joined by the staircase and the horizontal space available for the staircase. From these measurements the number of treads, riser height and going (the horizontal distance between the front of the riser on the lower tread and the front of the riser on the upper tread) required for a staircase complying with building regulations can be calculated and a staircase can thus be designed and built to fit the available space. The process of measuring, designing and manufacturing a staircase in this way can take along time, perhaps up to six weeks.

An alternative to a bespoke staircase of this type is to use a prefabricated staircase. However, such prefabricated staircases are only manufactured in a small range of sizes and are thus not suitable for all buildings.

Accordingly, there is a need for a system which permits a staircase to be manufactured and installed quickly in any building, regardless of the vertical distance between the downstairs and upstairs floors to be joined by the staircase.

SUMMARY OF INVENTION

According to a first aspect of the present invention there is provided a kit for assembling to produce a staircase, the kit comprising: a pair of stair supports; a plurality of tread supports for supporting treads when the staircase is assembled; and means defining the correct position of the plurality of tread supports on the stair supports to produce a staircase to a given specification.

The kit of the present invention provides all of the components required to assemble a staircase which complies with building regulations for any building, regardless of the distance between the floors to be joined by the staircase.

The means defining the correct position of the plurality of tread supports on the stair supports may comprise a template.

The template may define the correct position of the plurality of tread supports on the stair supports for a plurality of staircases of different specifications.

Thus, a single kit may be provided which is suitable for assembling a staircase according to a number of different specification.

The tread supports may be generally triangular.

Triangular tread supports provided support surfaces to which treads and risers can be securely attached.

The kit may further comprise a plurality of treads.

The may further comprise a plurality of risers.

The treads may be provided with grooves for receiving part of a riser of an adjacent step of the staircase. Thus the risers can be securely received and maintained in the correct position to maintain the integrity of the staircase.

The kit may further comprise a plurality of blocks for securing a tread to a riser of an adjacent step of the staircase.

In an alternative embodiment of the invention the means defining the correct position of the plurality of tread supports on the stair supports may comprise markings on the stair supports.

Ina further alternative embodiment, the means defining the correct position of the plurality of tread supports on the stair supports may comprise pre-drilled holes, grooves or cut outs in the stair supports.

A plurality of different groups of holes, cut-outs or grooves may be provided, each group corresponding to a particular staircase specification.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
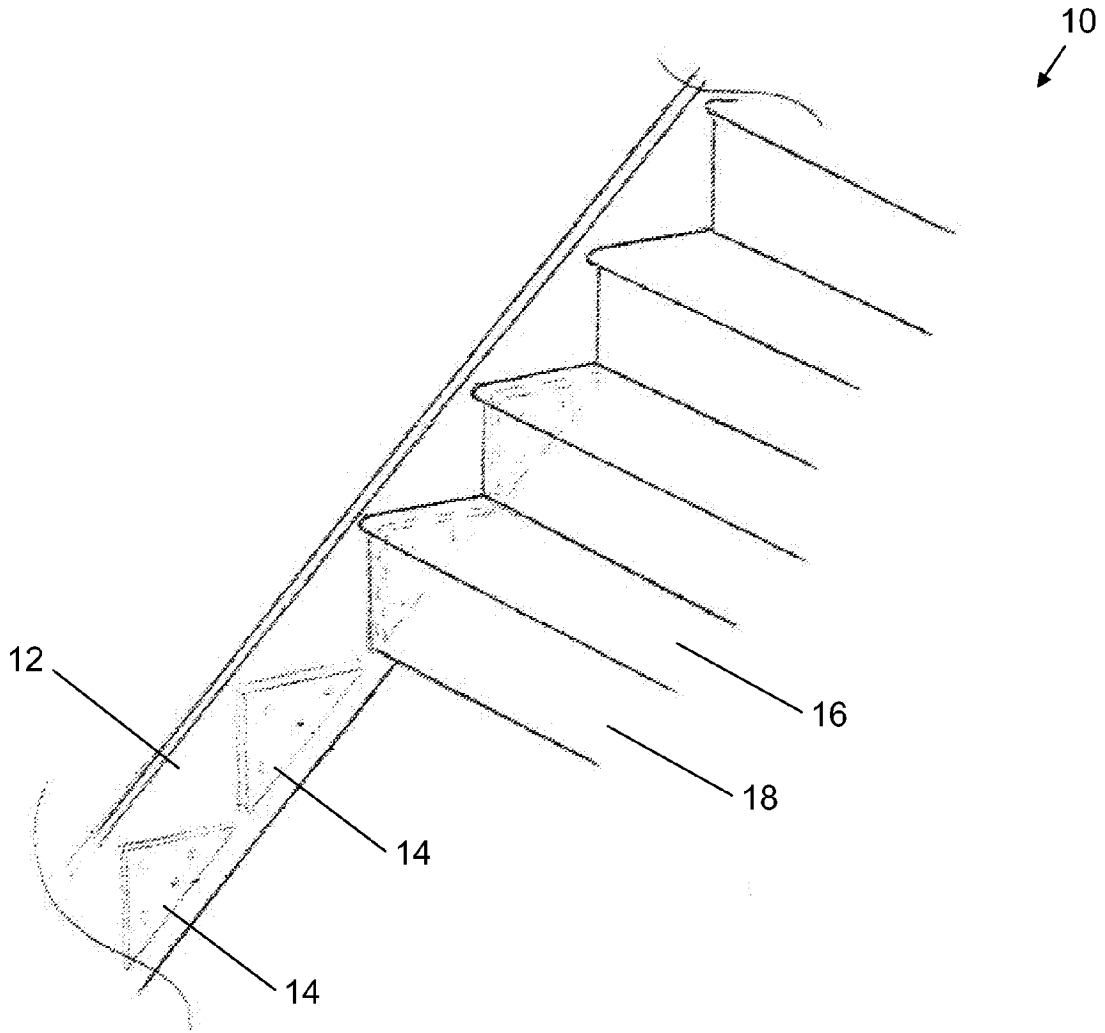
FIG. 1 is a cutaway view showing a staircase in partially complete condition to illustrate a staircase produced using an embodiment of the invention.
Figure 2:
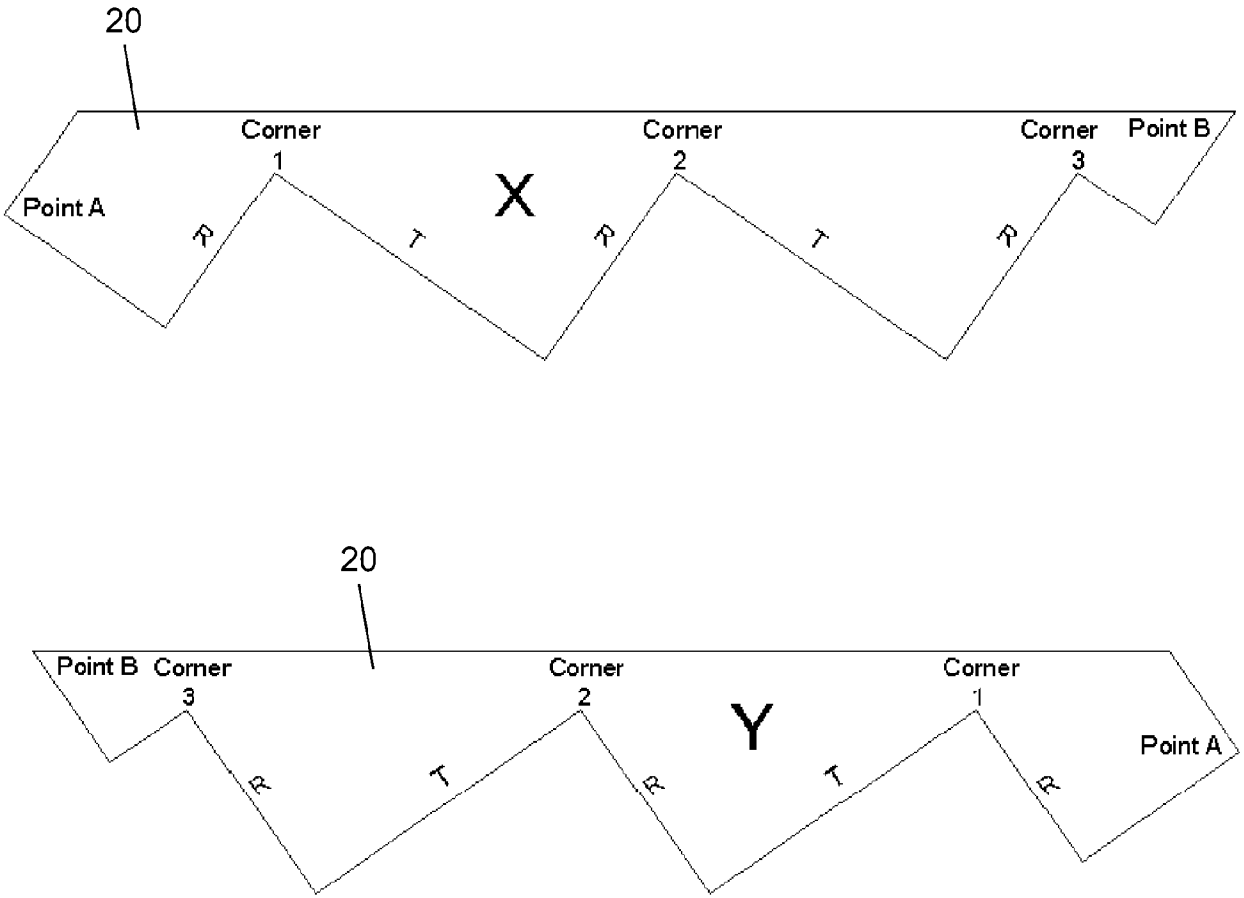
FIG. 2 is a schematic illustration of templates which may be provided as part of a kit according to an embodiment of the present invention.

Referring first to FIG. 1, a partially assembled staircase is shown generally at 10, and comprises a pair of stair supports or strings 12, to which a plurality of generally triangular tread supports 14 are attached to support treads 16 and risers 18 of the staircase 10.

The staircase 10 is assembled from a kit containing the components required to construct a staircase to a given specification, i.e. complying with prevailing building requirements and fitting a particular floor to floor height.

Thus, the kit includes a pair of stair supports or strings 12 and a number of tread supports 14 which can be positioned on the strings 12 to support treads 16 of the staircase. The kit also includes means for defining the correct position of the tread supports 14 on the strings 12 to construct a staircase to a particular floor to floor height specification which complies with prevailing building regulations.

In one embodiment the means for defining the correct position of the tread supports 14 on the strings 12 comprises a template or templates. Examples of templates for the left and right strings 12 of a staircase 10 are shown at 20 in FIG.

2. The templates 20 are used to position the tread supports 14 correctly on the strings 12 during construction of a staircase 10, as is explained below.

Figure 3:
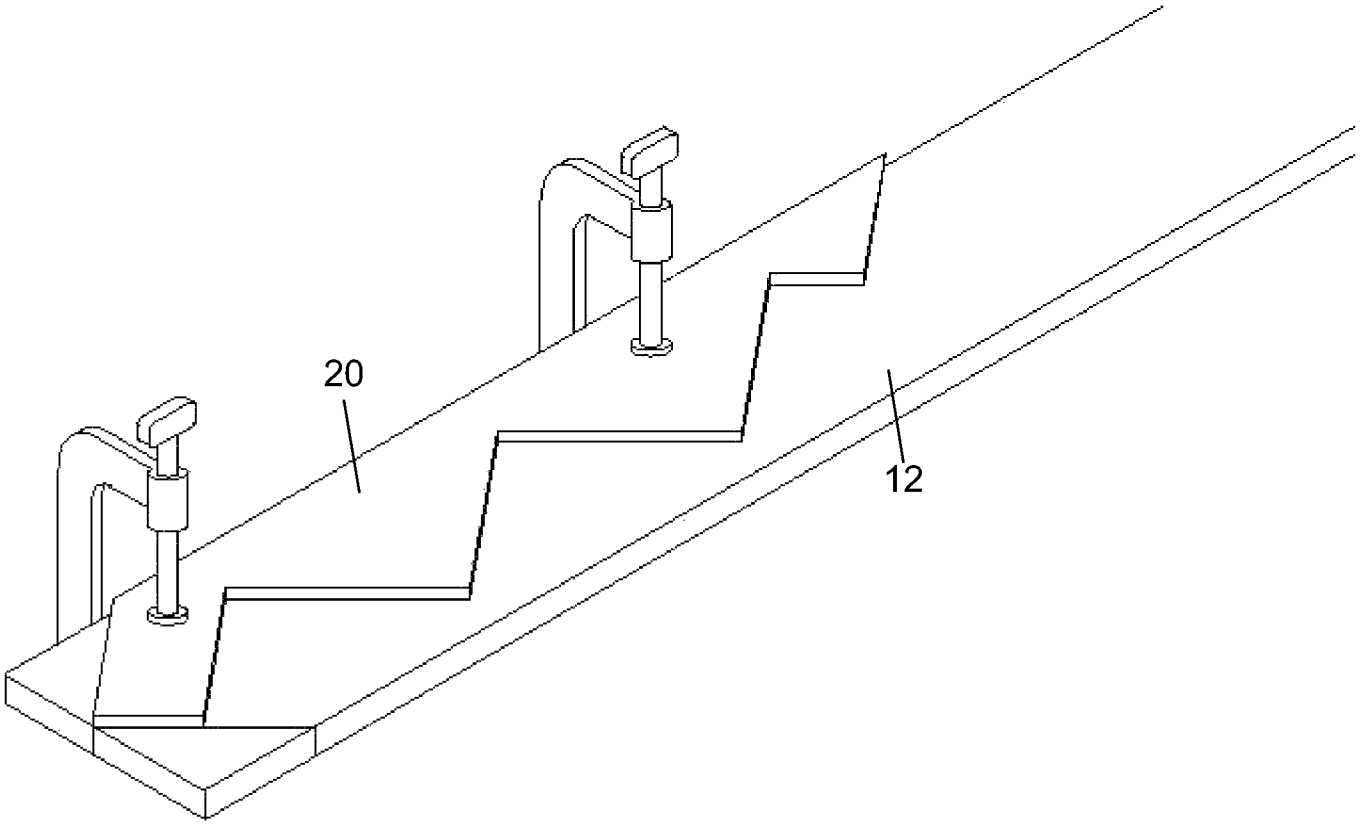
FIG. 3 is a schematic perspective view showing a template of FIG. 2 in use.

In a first step, illustrated in FIG. 3, the template 20 is securely clamped to the string 12 and an end of the string 12 is marked by drawing around an end of the template 20. The template 20 is then removed and the marked end of the string 12 is cut to the correct shape.

Figure 4:
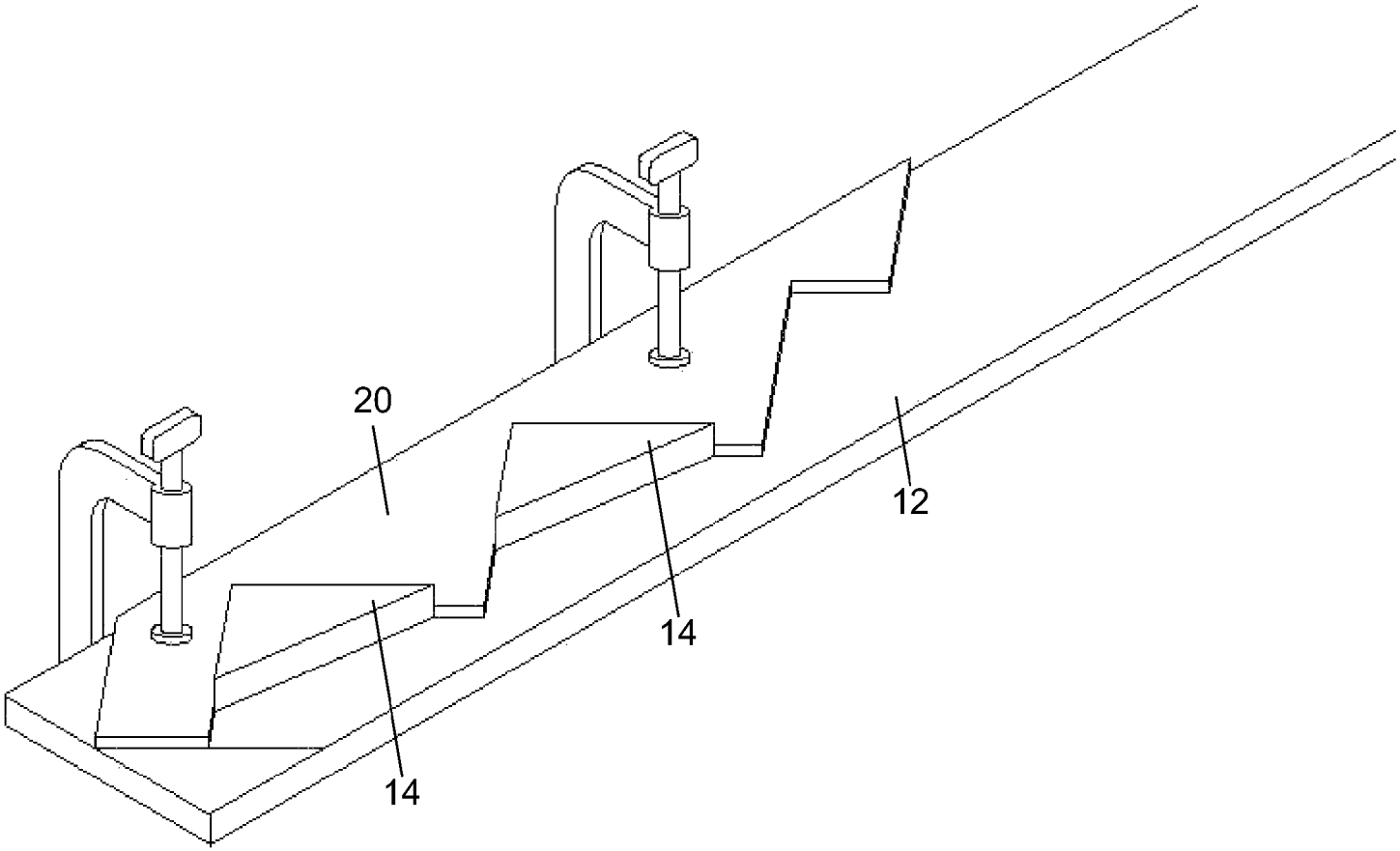
FIG. 4 is a further schematic perspective view showing a template of FIG. 2 in use to locate tread supports.

In a next step, illustrated in FIG. 4, the template 20 is again securely attached to the string 12, and a tread support 14 is positioned correctly using the template 20. In the example shown in FIG. 4 the generally triangular tread support 14 is positioned by slotting it into a generally triangular recess in the template 20. The tread support 14 is then secured in this position using, for example, glue, screws, nails or other fixing means. The complementary generally triangular shapes of the tread supports 14 and the recess of the template 20 allows the tread supports to be positioned with a high degree of precision.

Figure 5:
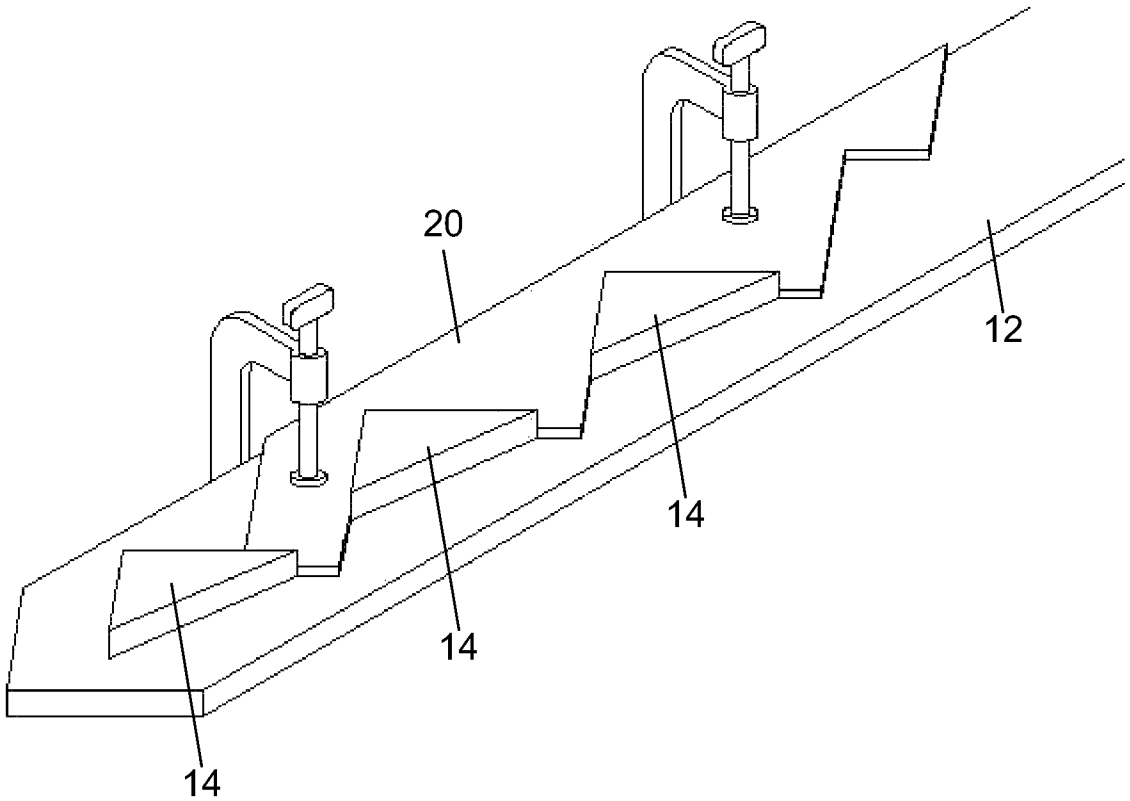
FIG. 5 is a further schematic perspective view showing a template of FIG. 2 in use to locate tread supports.
Figure 6:
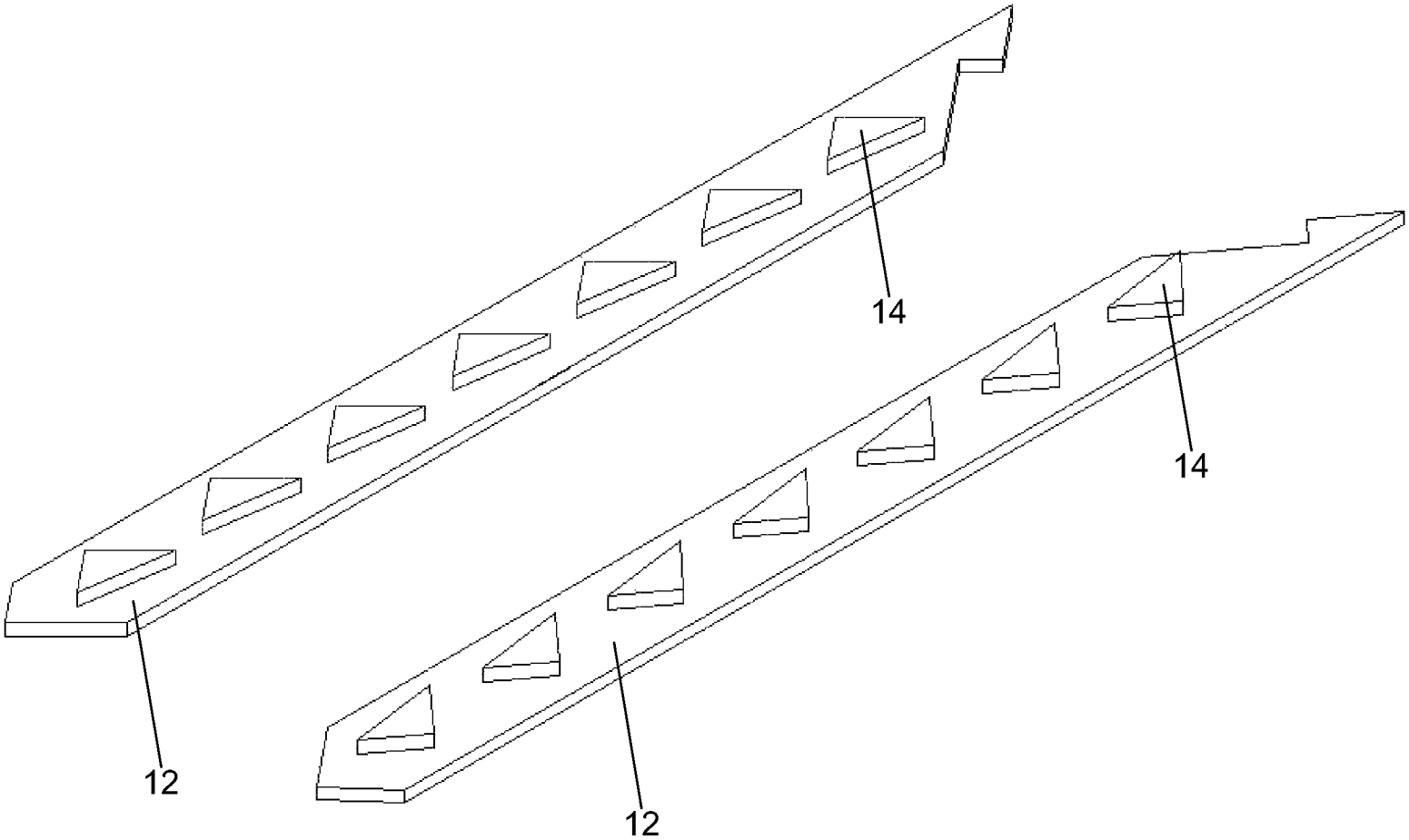
FIG. 6 is a schematic perspective view showing left and right stair supports with correctly positioned tread supports.
Figure 7:
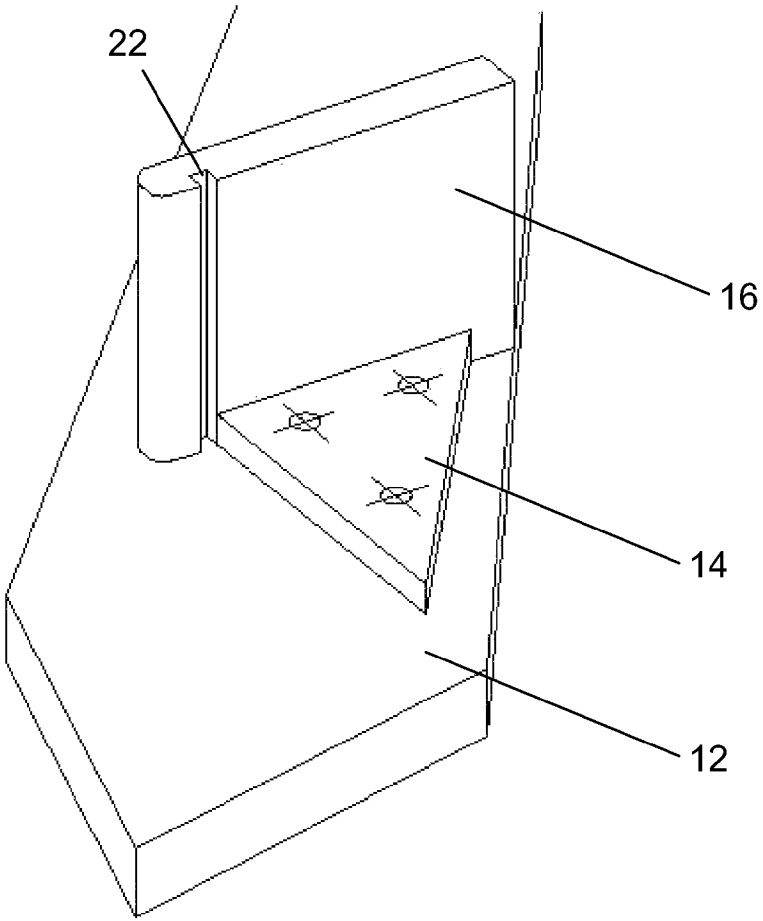
FIG. 7 is a schematic perspective view showing a tread attached to a tread support.

The template 20 is then removed from the string 12 and securely clamped in a new position defining the correct position of the next tread support 14, as is illustrated in FIG. 5. The tread support 14 is secured in position as described above, and the process of removing and repositioning the template 20 to define the correct positions of subsequent tread supports 14 continues until all of the tread supports 14 are correctly positioned on the string 12, as shown in FIG. 6.

Once all of the tread supports 14 are securely attached to the strings 12 the treads 16 and risers 18 can be securely attached to surfaces of the tread supports 14 using glue, screws, nails or other fixing means.

Figure 8:
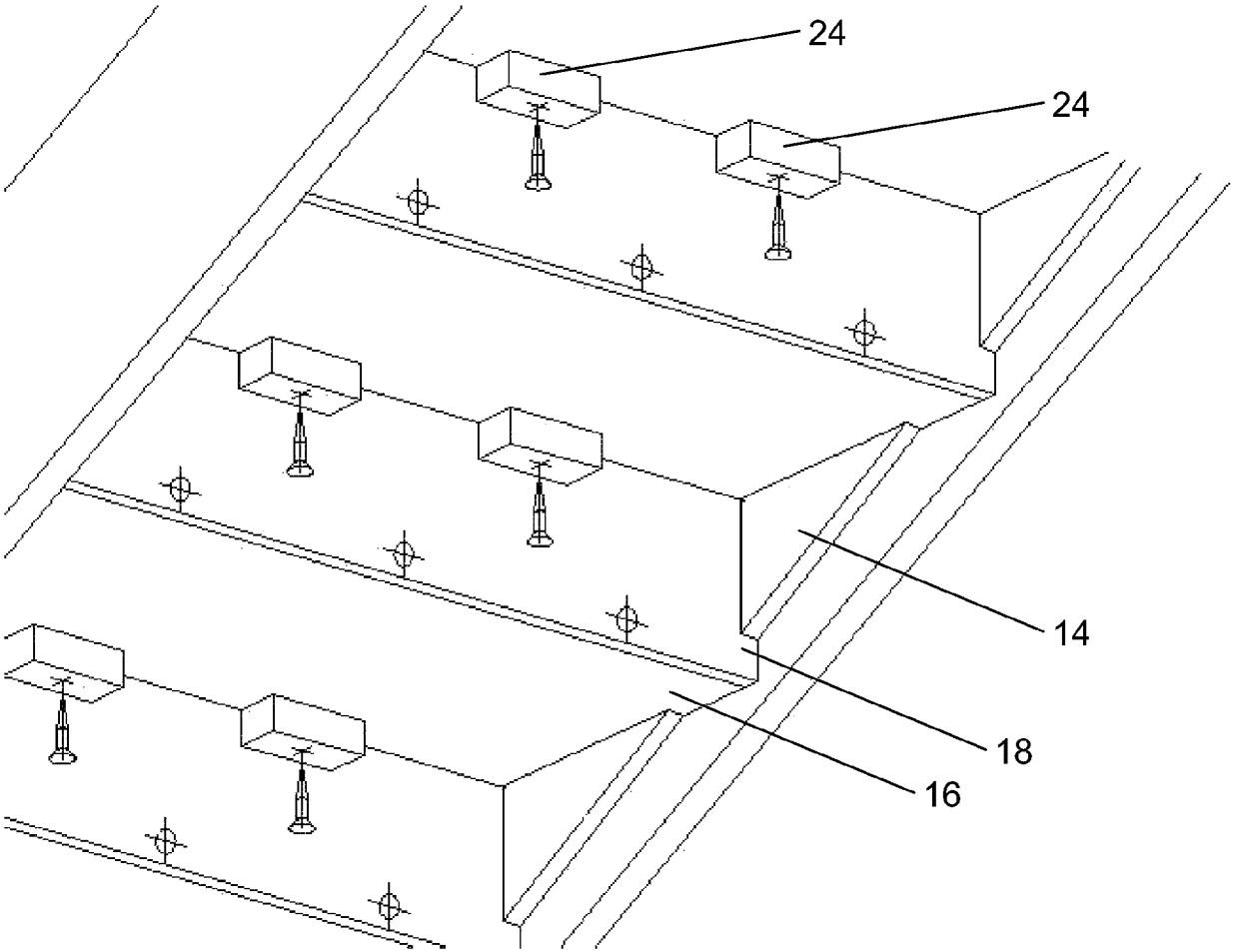
FIG. 8 is a schematic perspective view showing the underside of a staircase assembled from a kit according to an embodiment of the present invention.

As is shown in FIG. 8, the treads 16 may be provided with grooves 22 in their undersides for receiving the risers 18. In this case a tread 16 is attached to an upper surface of a tread support 14 such that a front surface of the tread support 14 is flush with an edge of the groove 22, so that when an edge of a riser 18 is received in the groove 22 the rear face of the riser 18 abuts the front surface of the tread support such that the riser can be glued or otherwise securely attached to the front surface of the tread support 14.

Thus the risers 18 can be securely received and maintained in the correct position to maintain the integrity of the staircase.

In a further step, the a riser 18 is secured to the tread 16 of an adjacent step of the staircase 10 using blocks 24. Glue is applied to a first face of the block 24 and to a second face of the block 24 which is perpendicular to the first face and the block 24 is positioned in the interior angle defined by the tread 16 and the riser 18 such that the first face abuts the tread 16 and the second face abuts the riser 18, thereby securing the tread 16 to the riser 18 of an adjacent step of the staircase 10. For extra security the block 24 may also be screwed to the tread 16.

The template 20 may be provided for a specific staircase specification such that only a staircase to that specification may be assembled from a particular kit. in this case, a merchant may be required to stock a range of kits, each kit in the range having a different template, such that each kit may be used to assemble a staircase to a given specification.

Alternatively, the template 20 may be provided with markings allowing it to be cut to the correct shape and size for a number of different staircase specifications, such that a single kit may be provided which can be used to assemble a staircase to a number of different specifications.

In the example above, the means for defining the correct position of the tread supports 14 on the strings 12 is a template, but alterative means may also be used. For example, the strings 12 may be provided with markings indicating positions at which the tread supports 14 should be attached to achieve a staircase for a particular floor height. These markings may be labelled with numbers, letters or other labels, and a table may be provided with the kit, indicating which markings correspond to particular floor to floor heights. Thus, to construct a suitable staircase a builder or joiner would measure the floor to floor height and consult the table to determine which set of labelled markings (e.g. marking set 1, 2, A, B etc) correspond to that floor to floor height. The builder would then attach the tread supports 14 to the strings 12 at positions indicated by the markings corresponding to the desired floor to floor height. Treads 16 and risers 18 (which may be provided as part of the kit, or which may be supplied separately) can then be attached to the tread supports 14 to construct the staircase.

In another example, a number of templates may be provided with the kit, each template corresponding to a particular floor to floor height. Again, a table may be provided indicating which template to use for a particular floor to floor height. The templates can be placed over the stair supports to indicate the positions at which the stair support blocks should be attached to the stair supports to achieve the desired floor to floor height.

In another example, the strings 12 may be provided with pre-drilled holes, or with grooves, cut-outs or the like. A number of different groups of holes, cut-outs or grooves may be provided, each group corresponding to a particular floor to floor height. The tread supports 14 may be provided with protruding dowels, projecting formations or tongues which correspond in shape to the holes, cut-outs or grooves such that the tread supports 14 can be attached to the strings 12 by engaging them with an appropriate group of holes, cut-outs or grooves. By consulting a table or illustration provide with the kit the builder or joiner can determine which of the groups of holes, cut-outs or grooves should be used to achieve a staircase of a desired floor to floor height, and the tread supports 14 can be attached to the strings 12 at the appropriate positions by means of the dowels, protruding formations or tongues. Treads 16 and risers 18 can then be attached to the stair support blocks to construct the staircase of the desired floor to floor height. In an alternative example the tread supports 14 may be omitted, and instead treads 16 and risers 18 may be attached directly to the strings 12 by means of dowels, tongues or protruding formations which engage with pre-drilled holes, grooves or cut-outs in the strings, with the appropriate holes, grooves or cut-outs for the desired floor to floor height being selected by reference to a table, chart or diagram supplied with the kit which provides information on which group of holes, groove or cut-outs to use to achieve a desired floor to floor height.

Although the staircase kit described above and illustrated in the Figures is for a straight staircase it will be appreciated that the principles of the invention can also be used to provide kits for left- and right-hand winder staircases, and thus the invention extends not only to a kit for a straight staircase but also to a kit for a left- or right-hand winder staircase.

It will be appreciated that the kit of the present invention allows a staircase to a given specification to be assembled quickly and easily without having to perform calculations for the correct number of treads, risers or going.

The invention claimed is:

1. A kit for assembling to produce a staircase, the kit comprising:

a pair of stair supports;

a plurality of treads;

a plurality of risers;

a plurality of tread supports for supporting treads when the staircase is assembled; and a template having markings that define a plurality of recesses, such that when the template is cut in accordance with the markings the template has a plurality of recess, each recess having a shape similar to a shape of the tread supports, each of the plurality of recesses being positioned such that when the template is coupled to one of the stair supports, the template defines the correct final position of the plurality of tread supports on the stair supports to produce a staircase to a given specification, and wherein each of the plurality of treads and each of the plurality of risers are configured to be coupled with one or more of the plurality of tread supports.

2. A kit according to claim 1 wherein the markings define the correct position of recesses in the template on the stair supports for a plurality of staircases of different specifications.

3. A kit according to claim 1 wherein the tread supports are generally triangular.

4. A kit according to claim 1 wherein the treads are provided with grooves for receiving part of a riser of an adjacent step of the staircase.

5. A kit according to claim 1 further comprising a plurality of blocks for securing a tread to a riser of an adjacent step of the staircase.

6. A kit according to claim 1 for assembling to produce a straight staircase.

7. A kit according to claim 1 for assembling to produce a winder staircase.

8. A template for a kit according to claim 1.

9. A method of producing a staircase from a kit, the kit comprising a pair of stair supports, a plurality of treads, a plurality of risers, a plurality of tread supports for supporting treads when the staircase is assembled, a template having markings, the method comprising:

cutting a plurality of recesses in the template in accordance with the markings, wherein each of the plurality of recesses have a shape similar to a shape of the tread supports;

positioning the template on one of the stair supports in a first position defining the correct final position of a first tread support on the stair support;

securing a first tread support in the correct final position on the stair support by locating the first tread support in a recess of the template and securing the first tread support in position;

securing a second tread support in the correct final position on the stair support by locating the second tread support in a recess of the template and securing the second tread support in position;

moving the template to a second position defining the correct final position of a third tread support on the stair support by locating the second tread support in a recess of the template, such that the correct final position of the third tread support is defined by a recess of the template;

attaching at least one of the plurality of treads to at least one of the plurality of tread supports; and attaching at least one of the plurality of risers to at least one of the plurality of tread supports.

* * * * *